United States Patent [19]

Bertini

[11] Patent Number: 5,044,982

[45] Date of Patent: Sep. 3, 1991

[54] SEALED BULKHEAD CONNECTOR FOR VEHICLES

[75] Inventor: Carlo Bertini, Turin, Italy

[73] Assignee: AMP Incorporated, Harrisburg, Pa.

[21] Appl. No.: 610,174

[22] Filed: Nov. 7, 1990

[30] Foreign Application Priority Data

Nov. 10, 1989 [IT] Italy ..... 22344 A/89

[51] Int. Cl.[5] ..... H01R 13/60; H01R 13/73

[52] U.S. Cl. ..... 439/533; 439/352; 439/354; 439/556

[58] Field of Search ..... 439/342, 343, 345, 350–354, 439/357, 358, 367, 368, 595, 533, 552, 553, 555, 556, 557

[56] References Cited

U.S. PATENT DOCUMENTS

| | | | |
|---|---|---|---|
| 3,404,364 | 10/1968 | Paullus et al. | 339/61 |
| 3,753,212 | 8/1973 | Yamada et al. | 439/358 |
| 3,982,805 | 9/1976 | Irie | 339/59 R |
| 4,343,523 | 8/1982 | Cairns et al. | 439/595 X |
| 4,698,030 | 10/1987 | Ryll et al. | 439/752 |
| 4,906,204 | 3/1990 | Metzger | 439/533 X |

*Primary Examiner*—Larry I. Schwartz
*Assistant Examiner*—Julie R. Daulton
*Attorney, Agent, or Firm*—William B. Noll

[57] ABSTRACT

This invention relates to a multicontact, sealed electrical connector assembly, having a pair of matable housing members of the type for mounting on a support plate, where each housing member is provided with a plurality through cavities for containing a contact member matable with a complementary contact member secured within a corresponding cavity in the other housing member. More precisely, the invention is characterized in that the support plate is provided with a pair of inserts extending therethrough, and each housing member is provided with a flexible arm adapted to engage said insert in the mated position for the housing members and complementary contact members. Additional features thereof include the provision of a secondary locking mechanism for the mated housing members, a secondary locking mechanism for securing the contact members with the cavities, and means for sealing same.

6 Claims, 5 Drawing Sheets

SEALED BULKHEAD CONNECTOR FOR VEHICLES

BACKGROUND OF THE INVENTION

The present invention is directed to a multicontact, sealed bulkhead electrical connector to be secured within a support plate mounted on the bulkhead of a vehicle, such as a truck, to electrically. interconnect the engine compartment and cabin harness. More particularly, this invention relates to a multicontact electrical connector assembly having plural retention means, i.e. means for retaining contacts within appropriate housing cavities, and means for retaining matable housing portions to one another.

Prior art attempts to achieve these goals have resulted in complex connectors which were subject to a loss of electrical interconnection from uses in vehicles. For example, U.S. Pat. No. 3,404,364 describes a multicontact electrical connector having an insulating housing which has one part that is movable in a direction perpendicular to the housing axis. The terminal receiving cavities extend through the movable part so that the terminal can be inserted into the cavities when the movable part is in one position. After insertion, the movable part is moved to a second position which forms a shoulder in each cavity so that the terminals cannot be removed.

Another but improved such connector is described in U.S. Pat. No. 4,698,030. Like the former prior art connector, a lateral shifting or rotation of the matable housing members is required to prevent removal of the terminals from their respective cavities.

BRIEF SUMMARY OF INVENTION

The present invention eliminates such shifting or rotation movement, but is nevertheless effective in securely locking the housing members together in a way that prevents premature disconnection of the terminal contacts caused by vibrations. The features of the connector of this invention is achieved by an electrical connector, having a pair of matable housing members, of the type of mounting on a support plate, where each said housing member is provided with plural through cavities for containing a contact member matable with a complementary contact member secured within a corresponding cavity in the other said housing member. The connector hereof is characterized by a support plate having an insert extending therethrough, where said housing member is provided with a flexible arm adapted to engage said insert in the mated position for said housing members and complementary contact members. Additional features thereof include means for sealing the connector and conductor wires, along with primary and optional secondary locking means for securing the contact members within said cavities.

BRIEF DESCRIPTION OF DRAWINGS

Such exemplary features, as noted above, shall become more apparent from the following specification, particularly when read in conjunction with the accompanying drawings in which.

DETAILED DESCRIPTION OF PREFERRED EMBODIMENT

Figure 1:
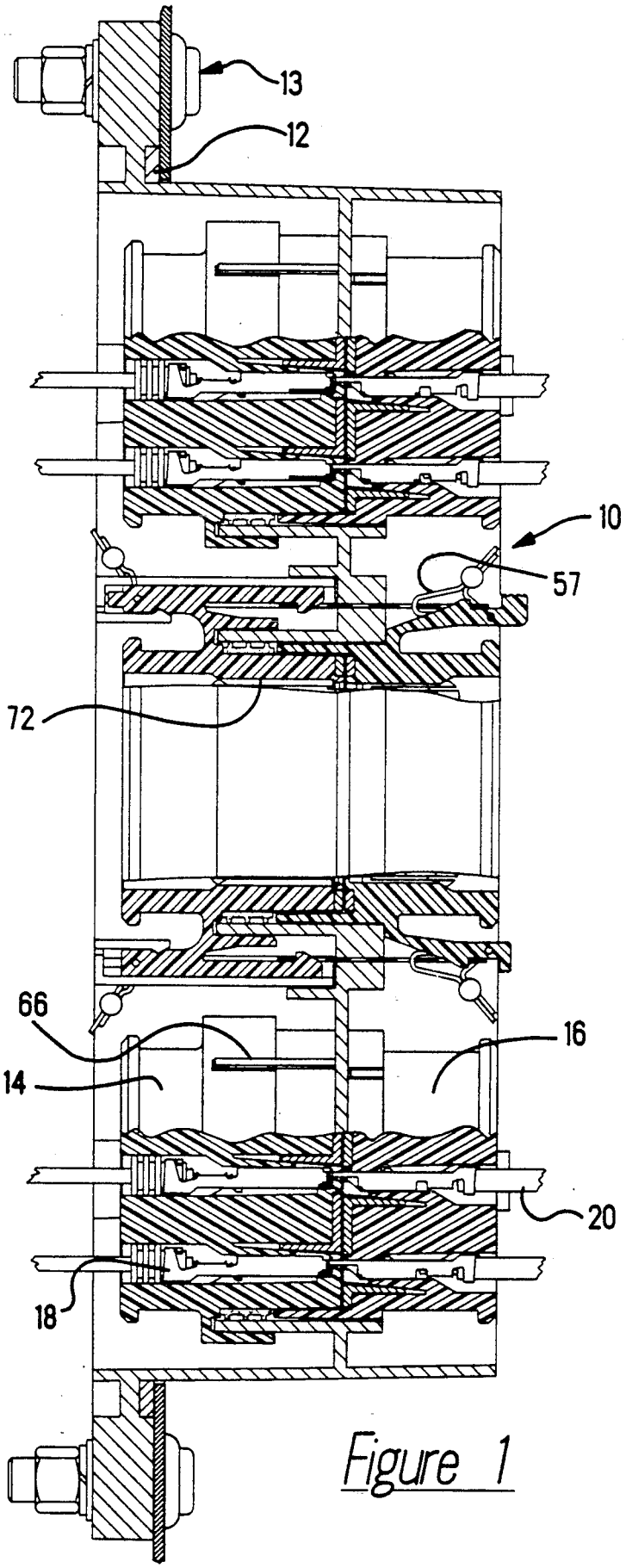
FIG. 1 is a partial sectional view illustrating the assembled components forming the multicontact, sealed electrical connector according to this invention.

Turning now to the several Figures illustrating the multicontact, sealed bulkhead electrical connector of this invention, reference is made to FIG. 1 showing the various components thereof. The connector 10, as illustrated therein, comprises a bulkhead support plate 12, mounting means 13 for mounting same to a bulkhead, matable housing members 14, 16 containing respectively female and male terminals or contact members 18, 20. As known in the art, and more particularly illustrated in U.S. Pat. No. 3,982,805, such contact members are stamped and formed from sheet metal stock and comprise a contact end, i.e. male tab or female receptacle, an intermediate portion, typically having means for engaging a cavity locking lance, and a rearwardly directed free end for receiving a conductor in electrical engagement therewith.

Figure 2:
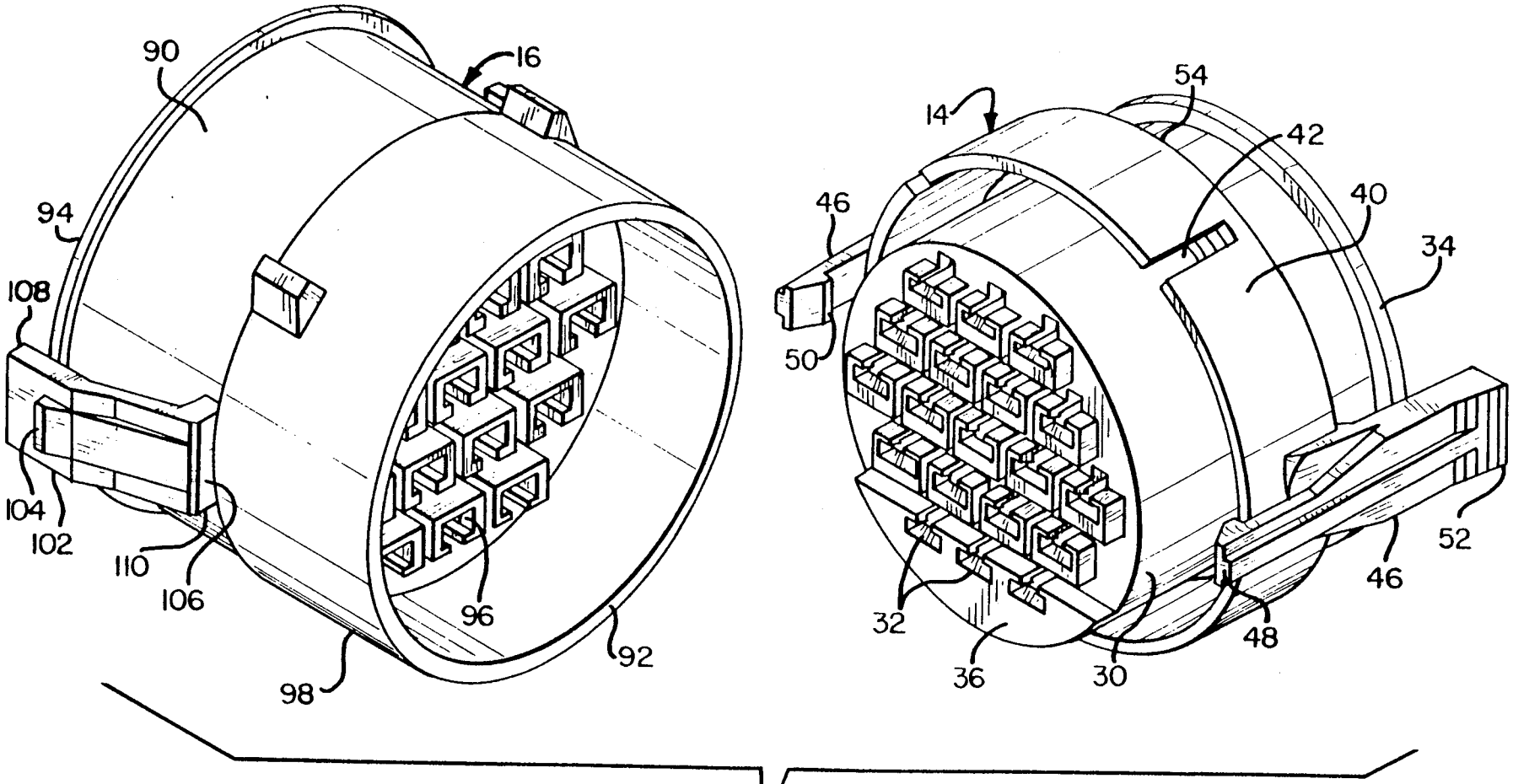
FIG. 2 is an enlarged perspective view of the matable housing members of the electrical connector hereof.
Figure 5:
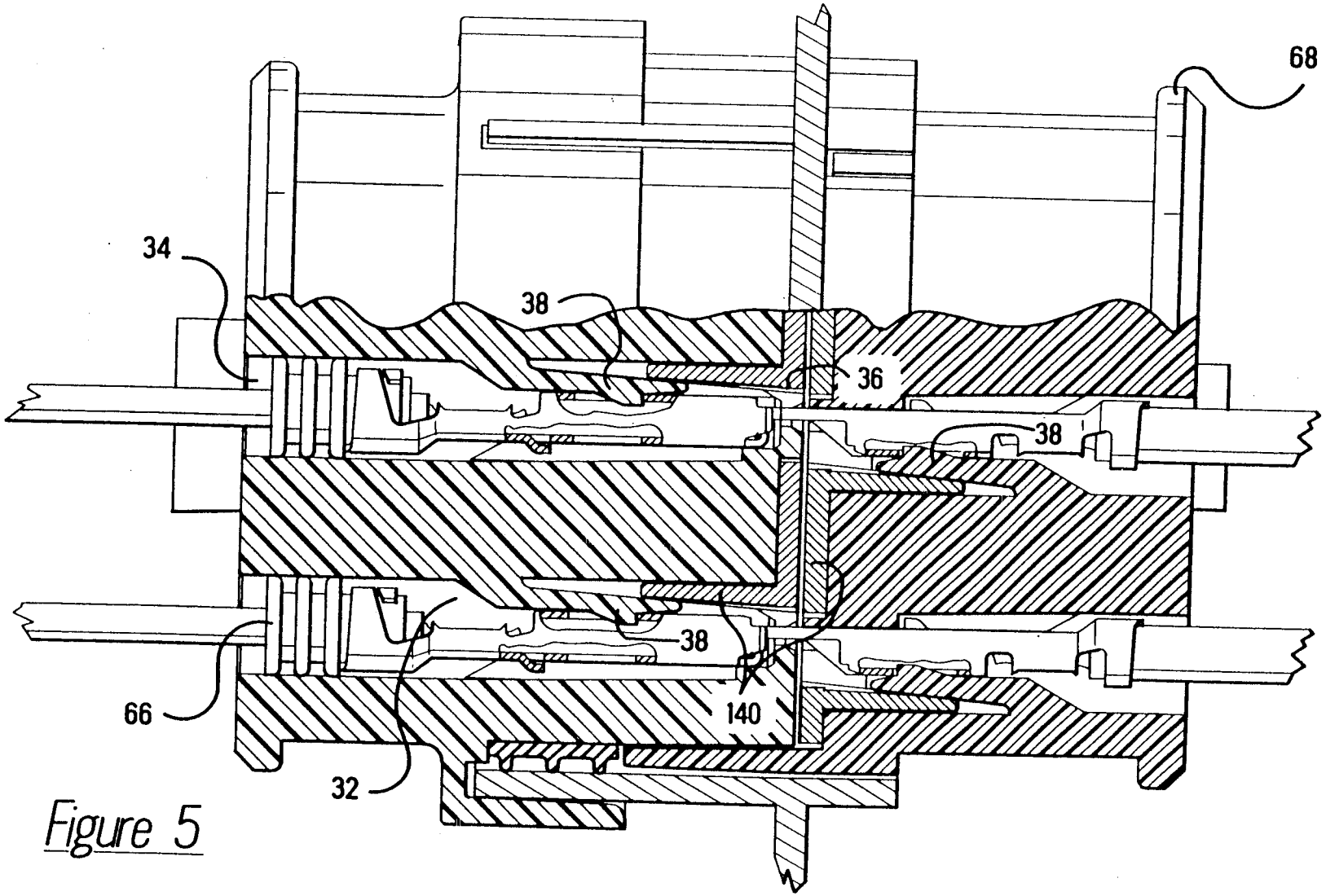
FIG. 5 is a partial sectional view, similar to FIG. 4, illustrating the terminal securing features of this invention.

The female housing member 14, the preferred engine mounting in a vehicular bulkhead assembly, and as illustrated in FIG. 2, right side, comprises a housing portion 30 having plural cavities 32 with each such cavity designed for receiving a single female contact member 18. As more fully shown in FIG. 5, left side, each such cavity 32 is characterized by a contact insertion end 34, and a contact mating end 36. Within said cavity there is provided a flexible lance 38 as the primary means for securing or locking the contact member 18 therein, which lance 38 is angled and spaced from the cavity wall thereof. A secondary and optional contact locking means will be discusses more fully hereinafter.

Externally, female contact member 14 is provided with an annular hood 40 about the housing portion 30 which opens toward the contact mating end 36. For polarization or registration purposes, such hood may be provided with one or more slots 42 for alignment with a complementary tab or rib 44, such as illustrated on the bulkhead support plate 12. Disposed at about 180 degrees from one another and secured to such hood, such as by molding integrally therewith, are a pair of connector locking lances 46. Such lances 46 are defined by a locking end 48 having a pair of inwardly directed locking projections 50, the function of which shall be apparent hereinafter. The opposite ends 52, which project above the hood shoulder 54, allow for flexing the lances 46, such as by squeezing together, to facilitate mating and locking, or unlocking as the case may be. Further, such opposite ends may be provided with a wire receiving slot 56 whereby when a wire 57 (FIG. 1) is inserted therein a premature unmating of the connector is prevented. Finally, in order to load the connectors hereof by automatic means, such as by the use of a block loading machine, one of the lances 46 may be provided with a pin 58, where the differences in height of the respective lances 46 may be sensed by such machine and the respective components aligned for terminal loading purposes.

It is contemplated that plural sealing means may be employed within or about the assembly hereof. For example, within the annular hood 40' against shoulder 60, a peripheral seal 62, preferably of an elastomeric material and containing annular ribs 64, may be provided. As will be apparent from the discussion which follows, such seal 62, more specifically the ribs 64, lie against a circular assembly receiving hood of the support plate 12, as more fully defined hereinafter.

Further, individual seals or grommets 66 may be provided on each conductor within the cavity, as shown in FIG. 6. Finally, the housing member 14, about the contact insertion end 34, may be provided with an annular rib or shoulder 68 for retaining a heat shrinkable tube (not shown) to seal the end thereof.

Figure 3:
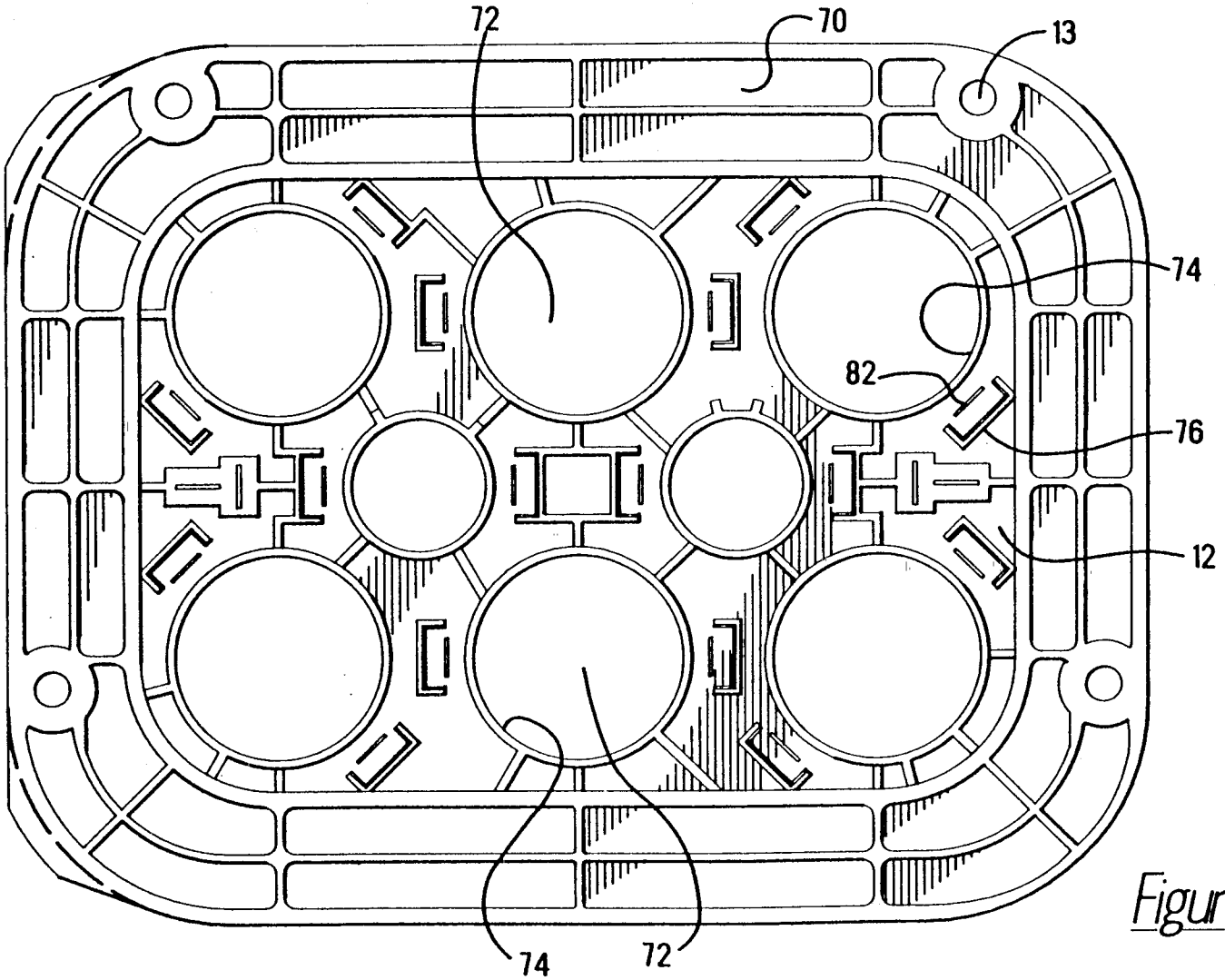
FIG. 3 is a plan view of a bulkhead support plate for receiving and securing plural electrical connectors according to this invention.
Figure 4:
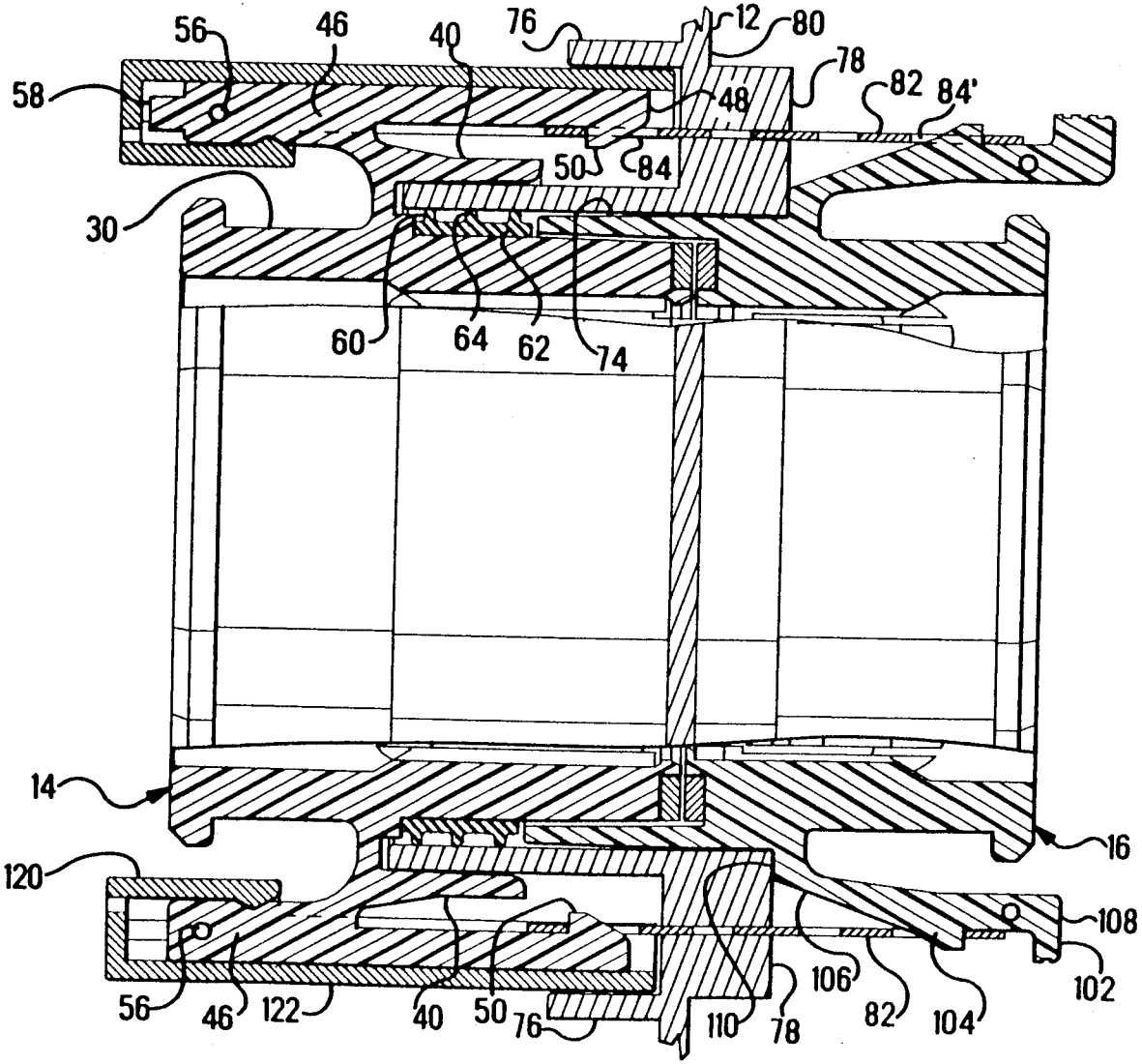
FIG. 4 is a sectional view of the electrical connector hereof illustrating the mating mechanism of the respective housing members.

The bulkhead support plate 12, as shown in FIG. 3, comprises a generally planar member having an outer flanged portion 70 for mounting to a cut-out within the bulkhead of a vehicle, for example. Inwardly from such flanged portion are a plurality of connector receiving openings 72, where one such opening is illustrated in the middle of FIG. 1. Each such opening 72 is defined by an assembly receiving hood 74, projecting generally toward the side receiving the female housing member 14, and a second encircling rib 76 (see FIG. 4) thereabout. Further, from FIG. 4 it will be seen that a broad encircling rib 78 is provided on the opposite face 80 of support plate 12. Projecting beyond such rib 78 and into the space between support projection 76 and hood 74 is a molded-in metal insert 82 provided with projection receiving holes 84, 84' along its length.

It will be seen, for example, as the female housing 14 is brought into engagement with the support plate 12, the locking lance 48 enters the space between support projection 76 and hood 74 where lance projection 50 enters into hole 84. By this arrangement, along with means to be described hereinafter, the female housing 14 is firmly secured to the support plate 12 and premature disengagement is prevented.

The male housing member 16, illustrated in perspective at the left of FIG. 2, comprises a housing portion 90 defined by a recessed mating end 92, a contact entry end 94, and a plurality of cavities 96, where each such cavity receives a male contact member 20 matable with a complementary female contact member. The mating end 92 is characterized by a circular hood 98 adapted to receive the housing portion 30 of female housing member 14. Finally about the contact entry end 94, a shoulder 100 may be provided to receive and retain a heat shrinkable tube (not shown).

Upstanding on opposite sides of the housing portion 90 are a pair of locking lances 102, each having on the outside thereof a locking projection 104. Such lances 102 are integrally molded at one end 106 thereof to the housing portion 90, such that the free end 108 is movable to and from such housing portion, whereby to facilitate the locking and unlocking thereof from the metal inserts 82. The integrally joined end 106 is characterized by a shoulder 110, which in the fully mated position rests against the broad encircling rib 78 of the support plate 12, FIG. 4. Further, in such mated position, the locking projection 104 seats in the insert receiving hole 84'.

Where the above represents a multicontact, sealed bulkhead electrical connector that may be readily secured within a support plate mounted on the bulkhead of a vehicle, there are further additional or optional features to enhance the performance thereof. For example, a locking cap 120 may be included to provide a means for locking the female housing member 14 to the support plate 12. Such locking cap 120 is characterized by a long outer wall 122 which extends between the support projection 76 and the locking lance 46, when such lance is in the mated position. That is, the outer wall 122 essentially wedges the locking lance 46 into engagement with the metal insert 82, thereby preventing its disengagement therefrom. The short or inner wall 124 is provided with a nipple 126 seats in a corresponding recess 128 in the locking lance 46. In operation, once the respective housing members 14, 16 are mated to the support plate 12, the locking cap 120 is slid along outside wall 130 of locking lance 46 where it enters between the rib 76 and such lance. Concurrent with the latter action, the nipple 126 begins to ride along the inside wall 132 and flexes outwardly. As such nipple 126 reaches the recess 128, such nipple seats therein.

It was noted previously that the contact members 18, 20 were secured within their respective cavities by locking lances 38, angled and spaced from the cavity wall. When the contact members 18, 20 are inserted into such housing cavities, the contact flexes the lance until the intermediate portion thereof is reached, at which time such lance returns to its normal position. A secondary locking is contemplated by this invention whereby an "L" shaped insert 140, one leg of which may be inserted into the cavity behind the angled lance 38 (see FIG. 5). By this arrangement, flexing or movement of the lance 38 is prevented thereby locking the contact members 18, 20 securely with their respective housings.

I claim:

1. An electrical connector assembly, having a plurality of pairs of matable housing members, of the type for mounting on a support plate, where each said housing member is provided with plural through cavities, each containing a contact member matable with a complementary contact member secured within a corresponding cavity in the other said housing member wherein said support plate is provided with a plurality of first inserts extending therethrough, and each said housing member is provided with a flexible arm adapted to engage a corresponding said first insert in the mated position for said housing members and complementary contact member, said support plate further provided with a plurality of openings where each opening is to receive a pair of complementary housing members, and that each said opening is provided with a pair of said first inserts, and that each said opening is provided with an annular hood and a support projection spaced therefrom, and that said first insert is intermediate said hood and said projection.

2. The electrical connector assembly according to claim 1, wherein an annular sealing means may be provided on each said housing member for sealing engagement with the said hood of said support plate.

3. The electrical connector assembly according to claim 1, wherein each said housing member contains a plurality of contact receiving cavities, and each said cavity includes a cantilevered flexible locking lance along the cavity wall for engagement with a contact inserted therein.

4. The electrical connector assembly according to claim 3, wherein a second insert may be incorporated therein to unlie said lance whereby to lock and support said contact.

5. The electrical connector assembly according to claim 3, wherein a locking cap may be provided to overlie said locking lance, whereby one leg thereof is wedged between a support projection and said second insert.

6. The electrical connector assembly according to claim 3, wherein the locking lances are provided with stop means which lies adjacent to the cavity opening at the housing member interface.

* * * * *